US010111518B2

(12) United States Patent
Blackburn

(10) Patent No.: US 10,111,518 B2
(45) Date of Patent: Oct. 30, 2018

(54) ADJUSTABLE ERGONOMIC WORKSTATION

(71) Applicant: Knape & Vogt Manufacturing Company, Grand Rapids, MI (US)

(72) Inventor: Nicholas Leonard Blackburn, Wellesley (CA)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 0 days.

(21) Appl. No.: 15/360,137

(22) Filed: Nov. 23, 2016

(65) Prior Publication Data

US 2018/0140089 A1 May 24, 2018

(51) Int. Cl.
*A47B 21/02* (2006.01)
*A47B 21/03* (2006.01)

(52) U.S. Cl.
CPC ..... *A47B 21/02* (2013.01); *A47B 21/0314* (2013.01); *A47B 2021/0321* (2013.01);
(Continued)

(58) Field of Classification Search
CPC ..... A47B 21/0073; A47B 2200/0056; A47B 9/16; A47B 21/02; A47B 21/0314; A47B 2021/0335; A47B 2200/0046; A47B 5/006; A47B 5/04; A47B 3/00; B66F 7/0608; B66F 7/065; F16M 11/24; F16M 11/2014; F16M 11/2092; F16M 2200/004; F16M 2200/063; F16M 11/38
USPC ..... 108/145, 144.11, 147, 93, 96, 116–118, 108/120, 43, 138, 33, 39, 14, 4, 9, 10, 108/50.02, 50.01, 146; 248/421, 562, 248/588, 585, 431, 432, 439, 280.11, 248/292.11, 919, 920, 92, 3, 923; 312/208.1, 223.3, 306, 312, 196
See application file for complete search history.

(56) References Cited

U.S. PATENT DOCUMENTS 2,545,515 A 3/1951 Gannett et al.
3,288,090 A * 11/1966 King ..... D06F 81/04 108/138

(Continued)

FOREIGN PATENT DOCUMENTS

EP 2842458 * 3/2015
EP 3132710 * 2/2017

(Continued)

OTHER PUBLICATIONS

Website for Rocelco ADR Sit to Stand Adjustable Desk Riser issued by Rocelco®, http://www.rocelco.com/product.php?pid=126, May 5, 2016, pp. 1-4. *Accepted As Prior Art.*

(Continued)

*Primary Examiner* — Janet M Wilkens
(74) *Attorney, Agent, or Firm* — Cook Alex Ltd.

(57) ABSTRACT

This disclosure provides an adjustable ergonomic workstation that includes first platform and a second platform that is coupled to and positioned below the first platform, wherein the first platform may be moved between at least a lowered position and a first raised position and wherein the coupling of the second platform to the first platform includes a tilt adjustment assembly wherein the second platform may be adjusted between at least a first angular position and a second angular position relative to the first platform.

1 Claim, 10 Drawing Sheets

(52) U.S. Cl.
CPC ..... *A47B 2021/0364* (2013.01); *A47B 2200/0082* (2013.01)

(56) References Cited

U.S. PATENT DOCUMENTS 4,383,486 A 5/1983 Reineman et al.
4,515,086 A * 5/1985 Kwiecinski ..... A47B 21/0314 108/104
4,625,657 A * 12/1986 Little ..... A47B 21/0314 108/138
4,844,387 A * 7/1989 Sorgi ..... F16M 11/10 108/5
4,898,103 A 2/1990 Pontoppidan et al.
5,005,492 A 4/1991 Ogino et al.
5,037,163 A * 8/1991 Hatcher ..... A47B 21/0314 108/143
5,048,784 A * 9/1991 Schwartz ..... A47B 21/0371 248/118.3
D323,436 S * 1/1992 Harrison ..... D6/655.14
5,273,250 A * 12/1993 Pemberton ..... A47B 21/0314 108/5
5,649,493 A * 7/1997 Blume ..... A47B 9/00 108/136
5,704,299 A * 1/1998 Corpuz, Jr. ..... A47B 21/0314 108/147
5,823,120 A 10/1998 Holmquist
5,961,231 A * 10/1999 Ambrose ..... A47B 21/0314 400/472
6,038,986 A 3/2000 Ransil et al.
6,283,047 B1 9/2001 Haller(-Hess)
6,691,626 B2 2/2004 Warner
8,065,966 B1 * 11/2011 Bacon ..... A47B 9/16 108/145
8,177,181 B2 * 5/2012 Papendieck ..... F16M 11/2014 248/280.11
8,671,853 B2 3/2014 Flaherty
8,800,454 B2 8/2014 Jones
9,055,810 B2 6/2015 Flaherty
9,113,703 B2 8/2015 Flaherty
9,277,809 B2 3/2016 Flaherty et al.
9,289,058 B2 3/2016 Flaherty
9,504,316 B1 * 11/2016 Streicher ..... A47B 21/02
9,554,644 B2 1/2017 Flaherty et al.
9,615,655 B1 4/2017 Huang
9,668,572 B2 6/2017 Ergun et al.
9,681,746 B1 6/2017 Chen
9,888,766 B2 * 2/2018 Chuang ..... A47B 9/16
2007/0095993 A1 * 5/2007 Yamamoto ..... A47B 21/0314 248/284.1
2007/0266912 A1 * 11/2007 Swain ..... A47B 9/02 108/145
2014/0158026 A1 * 6/2014 Flaherty ..... A47B 9/18 108/96
2015/0289641 A1 10/2015 Ergun et al.
2016/0120300 A1 5/2016 Ergun et al.
2016/0150876 A1 6/2016 Flaherty et al.
2017/0020280 A1 * 1/2017 Chuang ..... A47B 9/16
2017/0049224 A1 * 2/2017 Kim ..... A47B 21/02
2017/0095072 A1 4/2017 Flaherty et al.
2017/0127821 A1 5/2017 Carter et al.

FOREIGN PATENT DOCUMENTS

WO 9935936 * 7/1999
WO 2016129971 * 8/2016
WO 2016209513 * 12/2016

OTHER PUBLICATIONS

Website for Amazon.com, Standing Desk—the DeskRiser—Height Adjustable Sit Stand—Heavy Duty Supports up to 50 Lbs 32" Wide Sit Stand up Desk Converter, May 5, 2016, pp. 1-5. Accepted As Prior Art.
Website for Ergotron 33-406-085 WorkFit-TL Desktop Sit-Stand Workstation in Black, http://www.ergodirect.com, Jan. 25, 2017, pp. 1-3. *Accepted As Prior Art*.

* cited by examiner

ADJUSTABLE ERGONOMIC WORKSTATION

FIELD OF THE DISCLOSURE

This disclosure generally relates to ergonomic apparatus for use on a desk top, table top or other suitable generally horizontal surface. More particularly, it relates to apparatus that provides adjustable platforms for use in seated or standing positions.

BACKGROUND

Within work and home office environments, it has been determined that it may be beneficial to a person's health to not remain seated for extended periods of time. As a result, products such as stand-up desks or treadmill desks have been developed for use in standing or walking positions. The ergonomic office products industry also has developed height adjustable desks and tables, which permit a user to periodically change from a seated to a standing position. In addition, portable apparatus has been developed that may be placed on a horizontal surface, such as a desk top or table top, and that may be adjusted from a position for use when seated to a position for use when standing. Such portable apparatus is advantageous in that it is less costly than a stand-up desk or height adjustable table, it is able to be used with existing furnishings, and it typically is of a size that permits the apparatus to be readily moved or relocated, such as from one surface to another, or from a work environment to a home office. However, the existing products available are limited with respect to adjustability, which leaves them lacking in regard to being adequate ergonomic solutions.

SUMMARY

The disclosure provides a preferred embodiment as but one example of a configuration of an adjustable ergonomic workstation and methods for its use on a generally horizontal surface, such as a desk top or table top, in accordance with this disclosure. The illustrated example apparatus is height adjustable between at least a lowered position for use when seated and a raised position for use when standing. However, it will be appreciated that the example apparatus shown also may be adjusted to other positions, at other respective heights for additional raised positions between the two positions shown, which happen to be the lowermost and uppermost positions. As such, the workstation is configured to accommodate users of various heights, as well as providing for alternative hand position heights for a given user.

The preferred example adjustable ergonomic workstation includes a first platform that is located vertically above and is connected to a second platform. The first platform may be used for supporting equipment, such as a computer monitor or display, but could be used for supporting other equipment or objects, whether functional or merely for decoration. The second platform typically will be used as a work surface, such as for supporting one or more data entry devices, such as a keyboard, mouse or other suitable device, or for providing a surface that may be used for other tasks, such as writing or assembling items, or for any other desired purposes. The second platform may have a portion that extends forward of the first platform, where use of an item or input device on such an extended portion would be forward of, and therefore, not subject to vertical obstruction by the first platform.

The example workstation not only permits a user to adjust the height of the first and second platforms but also includes an advantageous tilt adjustment assembly, which may ergonomically enhance a user's experience by permitting angular adjustment of the second platform relative to otherwise remaining in a generally horizontal position, where it would be parallel to the first platform and/or to the generally horizontal surface on which the workstation rests. Indeed, a user may find relief in being able to adjust the second platform between at least a first angular position and a second angular position relative to the first platform, such as by having tilting the second platform to have a forward or rearward angle, so as to more comfortably position the work surface and/or data entry device for engagement by the user's hands.

In a first aspect, the disclosure provides an adjustable ergonomic workstation that includes a base, a leg assembly, a first platform and a second platform, with the leg assembly being connected to and extending between the base and the first platform, and being adjustable to move the first platform between at least a lowered position and a first raised position, and with the second platform being connected to and positioned below the first platform. The connection of the second platform to the first platform includes a tilt adjustment assembly wherein the second platform may be adjusted between at least a first angular position and a second angular position relative to the first platform.

The present disclosure addresses shortcomings in prior art sit to stand apparatus for use on a horizontal surface, such as may be provided by a desk top or table top. It will be appreciated that a variety of materials and methods of construction may be used to construct such apparatus and alternative configurations may be utilized while still being within the scope of the disclosure. Accordingly, it is to be understood that both the foregoing general description and the following detailed description are exemplary and provided for purposes of explanation only, and are not restrictive of the disclosure, as claimed. Further features and objects of the present disclosure will become more fully apparent in the following description of an example embodiment and from the appended claims.

BRIEF DESCRIPTION OF THE DRAWINGS

In describing the example apparatus and methods disclosed herein, reference is made to the accompanying drawings wherein like parts have like reference numerals, and wherein.

Figure 1:
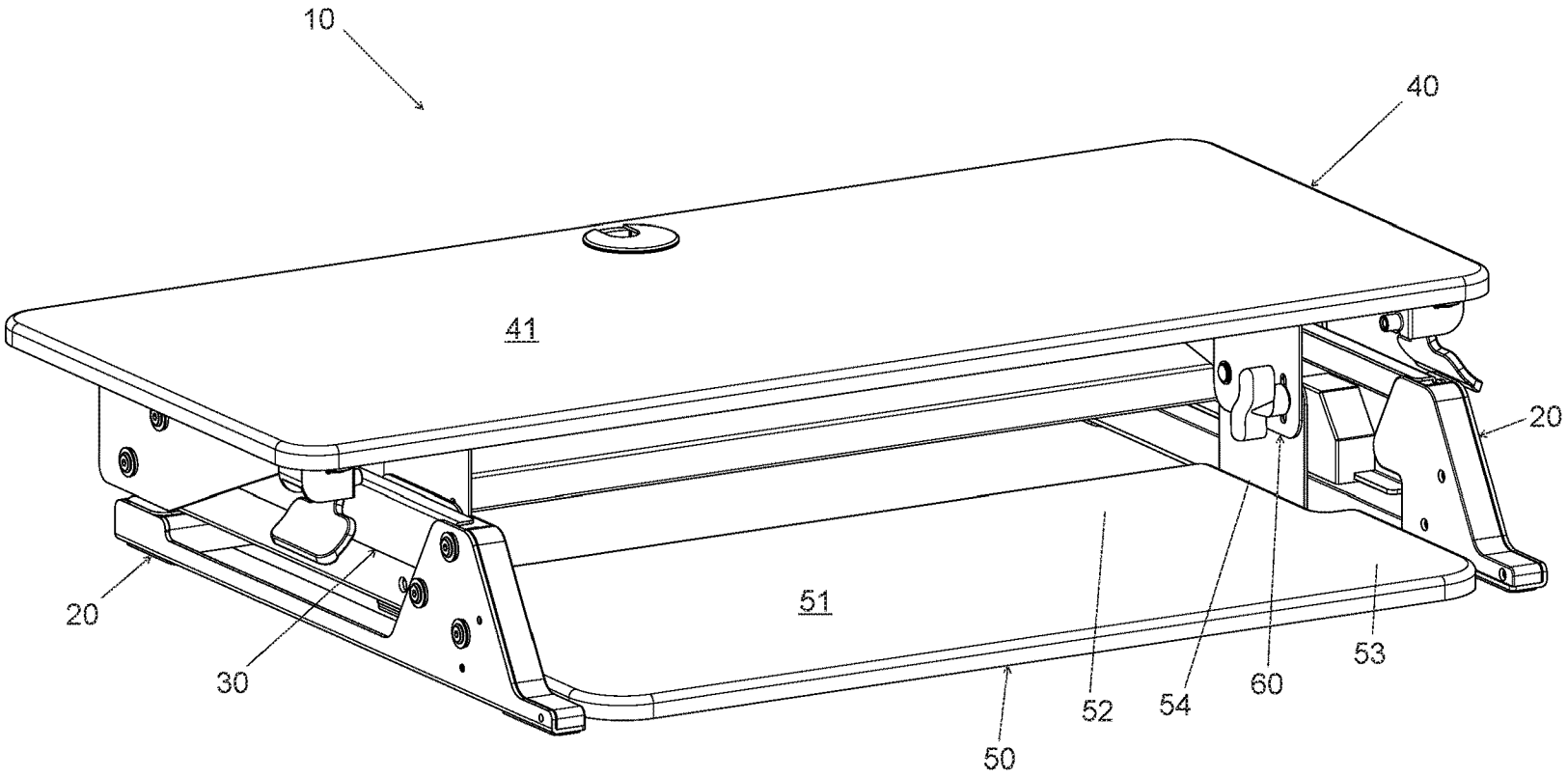
FIG. 1 is a front perspective view that shows an example of an adjustable ergonomic workstation having first and second platforms and being in a lowered position, and with portions of the height adjustment assembly removed for easier viewing of the underlying structure.

It should be understood that the drawings are not necessarily to scale and that actual embodiments may differ. While some mechanical details, including some details of fastening or connecting means and other plan and section views of the particular components are not included, such details are considered within the comprehension of those of ordinary skill in the art in light of the present disclosure. It also should be understood that the claims are not limited to the particular examples illustrated, but rather cover various configurations of adjustable ergonomic workstations.

DETAILED DESCRIPTION

This disclosure presents an example and discusses alternative adjustable ergonomic workstations and methods of using the same, which may be embodied in several forms. Persons of ordinary skill in the art will appreciate that the teachings of this disclosure are in no way limited to the example embodiment. On the contrary, it is contemplated that the teachings of this disclosure may be implemented in alternative configurations and environments.

Referring to FIGS. 1-10, it will be appreciated that an example adjustable ergonomic workstation 10 is provided for use between a lowered position, such as may be used when a user is seated, and a first raised position, such as may be used when a user is standing. As will be described in further detail herein, the workstation 10 includes a base 20, a leg assembly 30, a first platform 40 and a second platform 50. The leg assembly 30 is coupled to and extends between the base 20 and the first platform 40, and is adjustable to move the first platform 40 between at least a lowered position, as may be seen in FIG. 1, and a first raised position, as may be seen in FIG. 2. The second platform 50 is coupled to and positioned below the first platform 40. Also, the coupling of the second platform 50 to the first platform 40 includes a tilt adjustment assembly 60, wherein the second platform 50 may be adjusted between at least a first angular position and a second angular position relative to the first platform 40.

Figure 2:
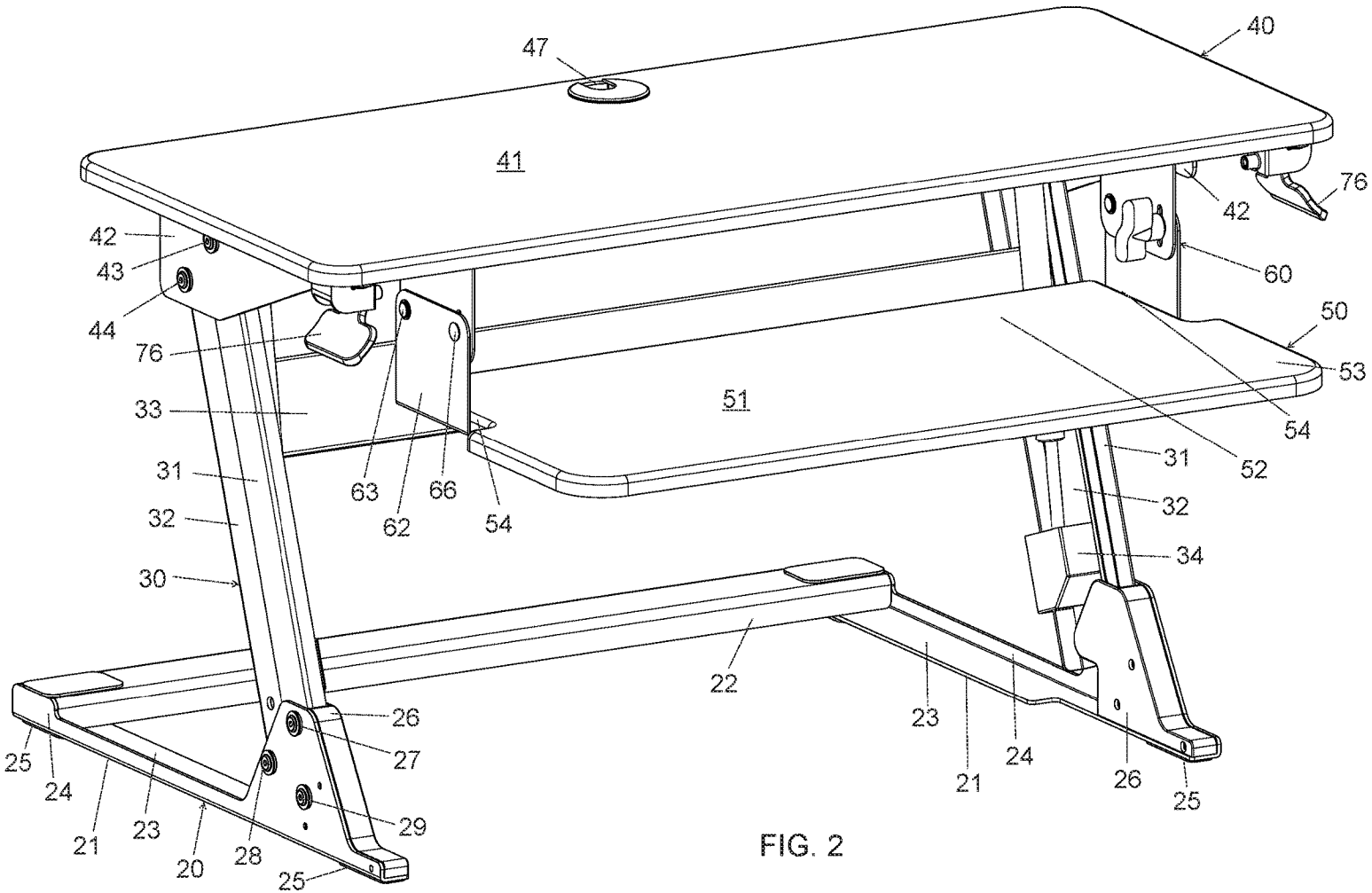
FIG. 2 is a front perspective view of the example workstation shown in FIG. 1, in a first raised position, having the second platform in an angular position parallel to the first platform, and with portions of the height adjustment assembly removed for easier viewing of the underlying structure.
Figure 3:
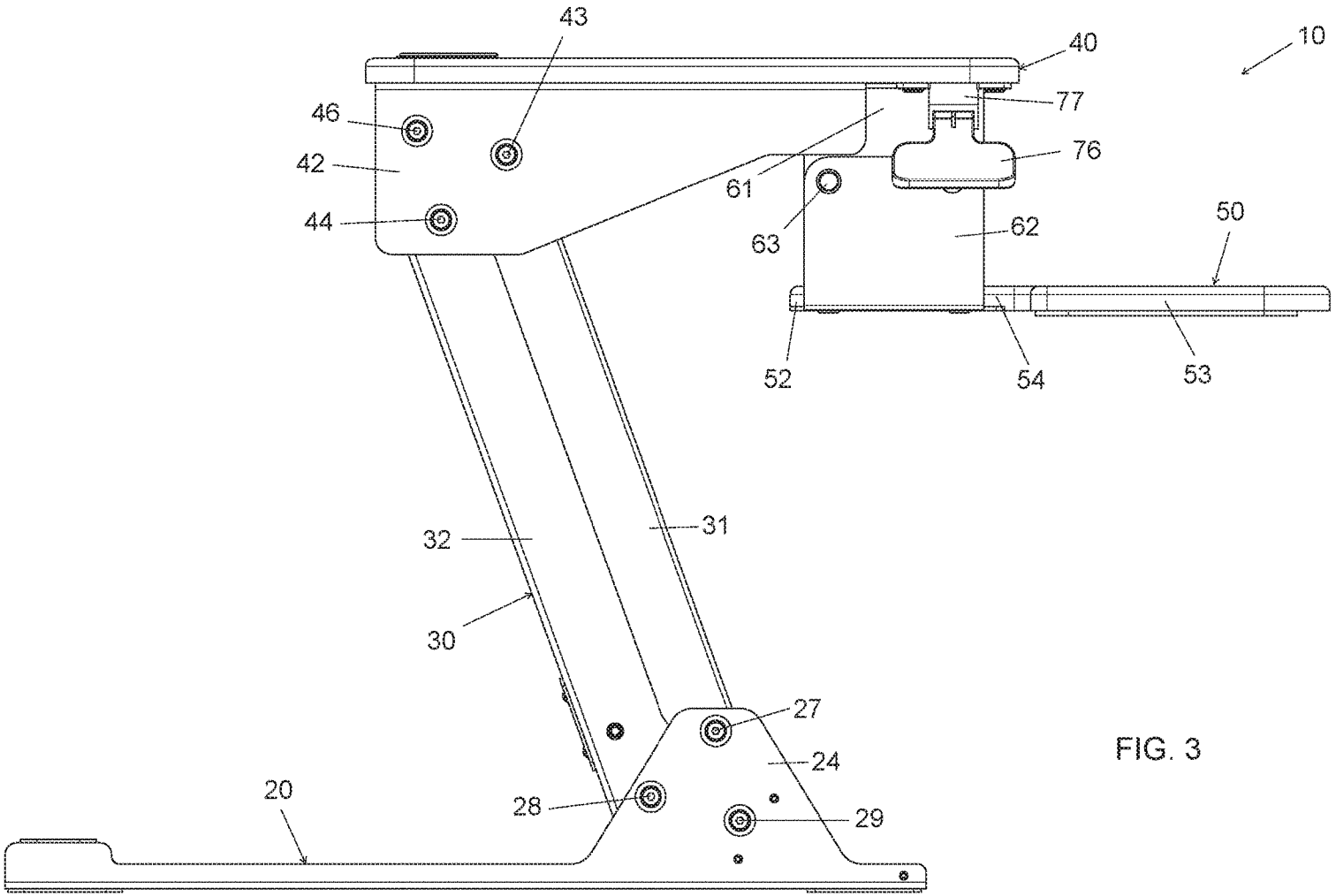
FIG. 3 is a side view of the example workstation in the position shown in FIG. 2.

As may be seen in FIG. 2, the base 20 includes a pair of spaced apart base members 21, which in this example workstation 10 are laterally spaced apart. The base 20 further includes a base cross member 22 that extends between and is connected to the base members 21. The connection of the base cross member 22 to the base members 21 helps to keep the base members 21 evenly spaced apart, for improved stability of the workstation 10. The base cross member 22 is located near the rear of the base members 21, so as to provide unobstructed space between the base members 21.

The base members 21 also are shown in a configuration that generally is L-shaped, with a flat lower portion 23 and an upstanding portion 24. The base cross member 22 is shown in a configuration that generally is a single U-shaped channel that is open downward, but it will be appreciated that more than one base cross member may be used and that the one or more base cross members may have a different configuration. The base members 21 and base cross member 22 may be constructed of rigid materials, such as metal, plastic or the like, and may be connected together by suitable means, such as by welding, adhesives or use of fasteners or the like. The base members 21 may have pads 25 located on their lower surface for floor protection and/or anti-skid purposes. The base members 21 also may include covers 26 for aesthetics and/or to shield moving parts and avoid potential pinch points. The covers may be constructed of suitable materials, such as plastic, metal or the like, and may be connected by snap fit, press fit, the use of fasteners or other suitable means of connection.

As may be seen in FIGS. 1 and 2, the first platform 40 has an upper surface that generally comprises a first planar surface 41 and includes a pair of spaced apart mounting brackets 42 connected to its lower surface. The second platform 50 has an upper surface that generally comprises a second planar surface 51. It will be appreciated that the first and second platforms 40, 50 preferably are constructed of rigid materials, such as wood, metal or plastic, may be generally rectangular in shape and may include apertures, impressions and/or upstanding features, although it will be appreciated that other shapes or configurations may be used. For instance, the first platform 40 of the example workstation 10 is shown with an aperture 47 for accommodating electrical cables or wiring, and may include an insert for aesthetics to limit the size of the opening after passing cable or wiring ends through the aperture 47. Also, because the second platform 50 is coupled to and positioned below the first platform 40, for convenience and to provide a significant unobstructed work area, the second platform 50 may include a rear portion 52 directly below the first platform 40 and a portion 53 that extends forward of the first platform 40, as may be seen in FIGS. 1-3 and 5.

The leg assembly 30 of the example workstation 10 includes two pair of legs coupled to the base 20, such as at the upstanding portion 24, and to the first platform 40, such as at the mounting brackets 42. Each pair of legs includes a forward leg 31 and a rearward leg 32. For improved rigidity and aesthetics, as well as to avoid pinch points, each leg 31, 32 of the example workstation 10 has an elongated L-shape, and each pair of legs has overlapping parallel planar portions of the respective L-shaped legs 31, 32. For instance, as may be seen in FIGS. 2, 3 and 5, an outer planar portion of the forward leg 31 may overlap an outer planar portion of the rearward leg 32. With each forward leg 31 being pivotally coupled to the first platform 40 at an upper end at pivot 43 and to the base 20 at a lower end at pivot 27, and each rearward leg 32 being pivotally coupled to the first platform 40 at an upper end at pivot 44 and to the base 20 at a lower end at pivot 28, it will be appreciated that each pair of legs 31, 32 of the leg assembly 30 together with the base 20 and first platform 40 forms a four bar linkage. The pivots used throughout the workstation 10 may be formed using any suitable fasteners, including tubular nuts that may be welded in place and accommodate bolts, or press fit or welded pins, rivets or the like. The pivots also may include bushings or other suitable means to reduce friction and enhance smooth operation.

It will be appreciated that the leg assembly 30 is adjustable to move the first platform 40 to at least a second raised position that is between the lowered position shown in FIG. 1 and the first raised position shown in FIG. 2. Indeed, with the particular example workstation 10 shown, the leg assembly 30 does not have predetermined intermediate positions, but rather is adjustable in a manner that permits the first platform 40 to be positioned at any height between the lowermost and uppermost positions.

To provide for better durability and smoother operation, the example workstation 10 includes upper stabilizer brackets 45. On each side of the example workstation 10, an upper stabilizer bracket 45 is coupled to the mounting bracket 42 and the upper end of the forward leg 31 at the pivot 43, is coupled to the same mounting bracket 42 and the upper end of the rearward leg 32 at the pivot 44, and is separately coupled at a post 46 to the same mounting bracket 42. The couplings of each stabilizer bracket 45 in this example are at pivots 43 and 44 and at post 46, but it will be appreciated that the stabilizer brackets 45 help to disperse the loads otherwise asserted at the upper pivots 43, 44. It also will be appreciated that the example workstation 10 includes lower stabilizer brackets that are similar to the upper stabilizer brackets 45, but which are not shown because they are hidden from view by the covers 26 of the base 20. The lower stabilizer brackets are coupled to the side members 21 of the base 20 at the lower ends of the forward and rearward legs 31, 32 at the respective pivots 27, 28 while also being separately coupled at a post 29, so as to provide benefits similar to those provided by the upper stabilizer brackets 45.

To add further stability and ensure coordinated movement of all components within the leg assembly 30 on the left and right sides of the example workstation 10, a leg cross member 33 is connected to each rearward leg 32 of the pair of legs. The leg cross member 33 is shown as a single rectangular tube, but it will be appreciated that more than one leg cross member may be used and that the one or more leg cross members may have a different configuration and be connected in different ways. The legs 31, 32 and leg cross member 33 may be constructed of rigid materials, such as metal or plastic, and may be connected by suitable means, such as by welding, adhesives or use of fasteners or the like.

Figure 4:
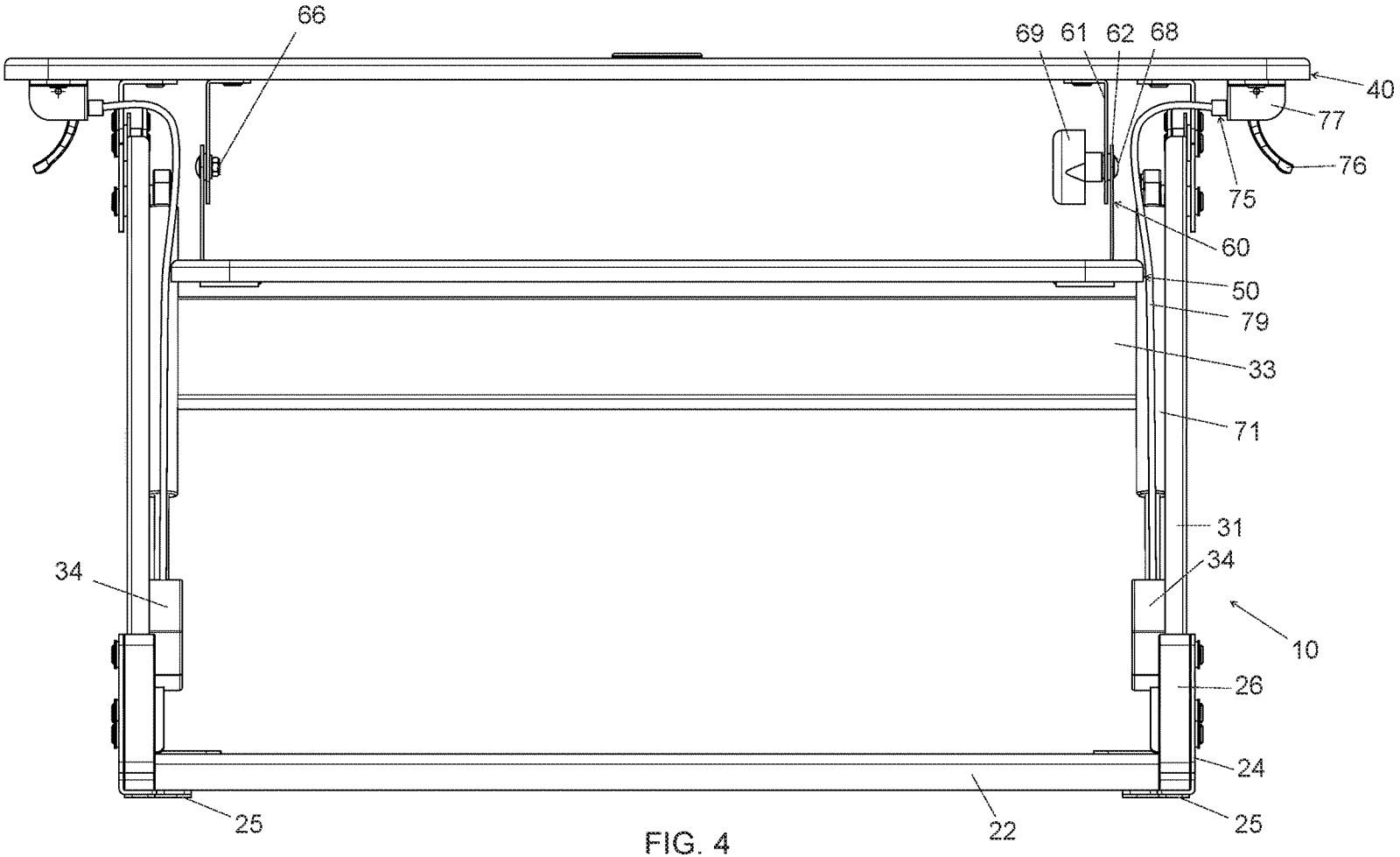
FIG. 4 is a front view of the example workstation in the position shown in FIG. 2.
Figure 5:
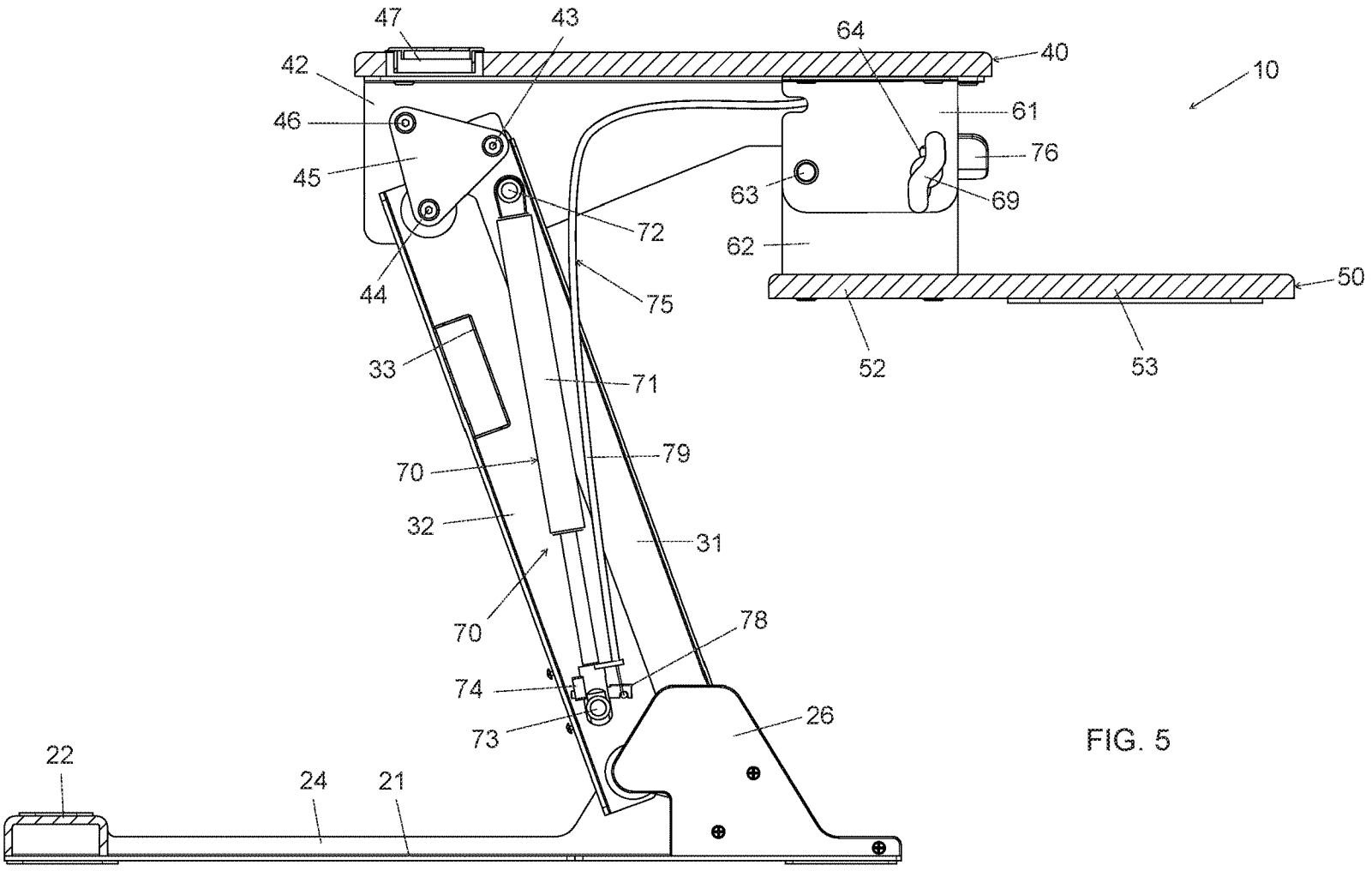
FIG. 5 is a cross-section side view of the example workstation in the position shown in FIG. 2, and showing a right portion with the second platform in a generally horizontal position.
Figure 6:
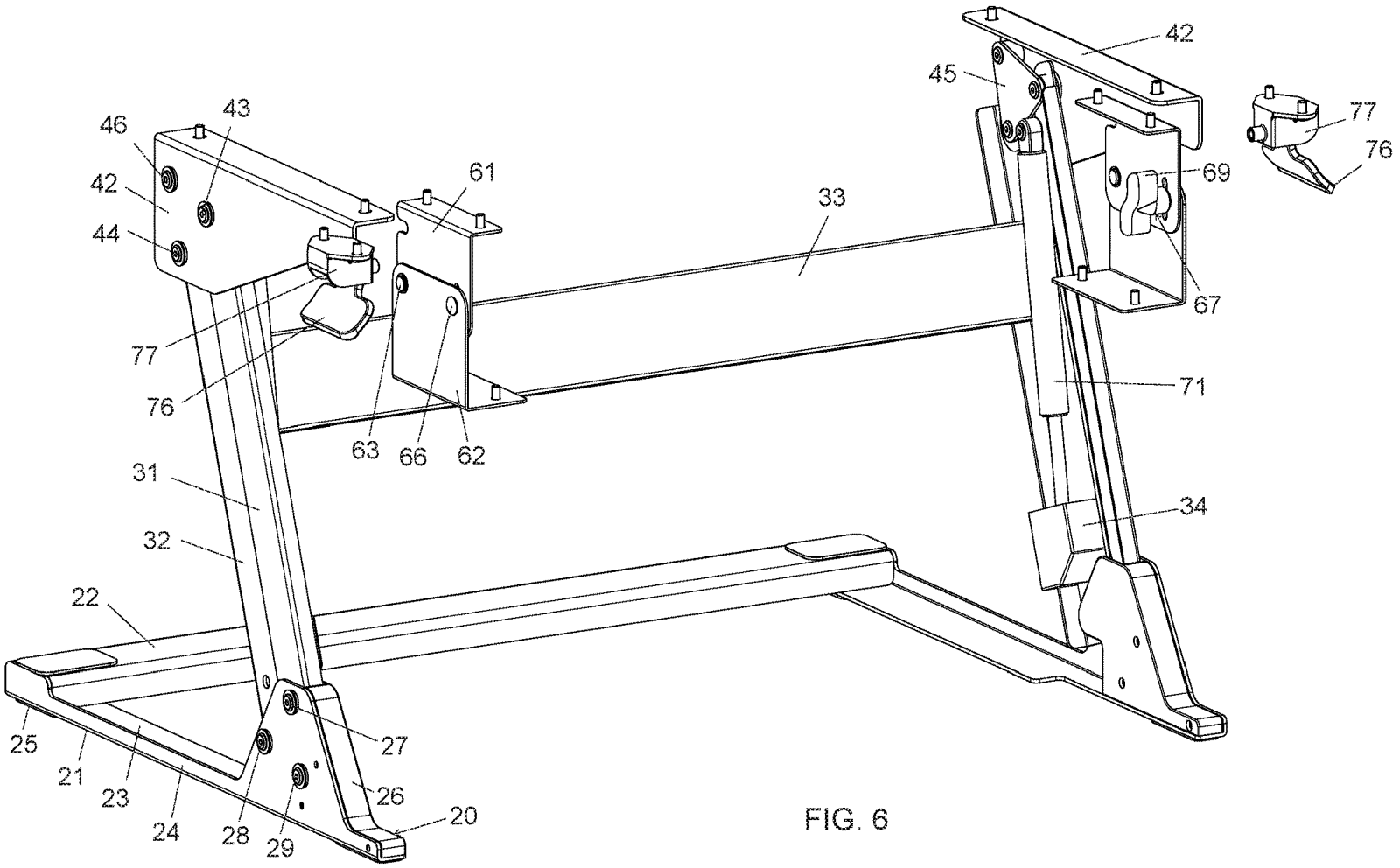
FIG. 6 is a front perspective view of the example workstation in the position shown in FIG. 2, and with the platforms and portions of the height adjustment assembly removed for easier viewing of the underlying structure.
Figure 7:
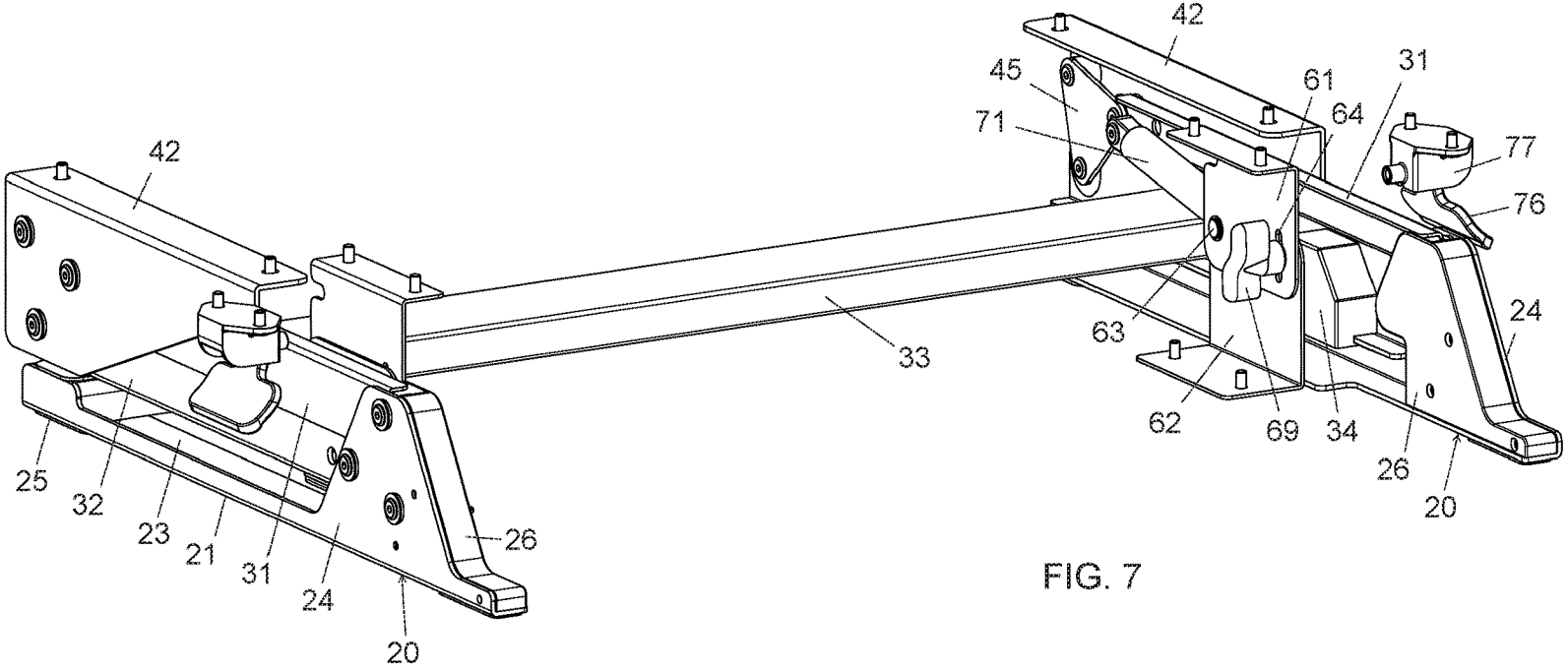
FIG. 7 is a front perspective view of the example workstation in the position shown in FIG. 1, and with the platforms and portions of the height adjustment assembly removed for easier viewing of the underlying structure.
Figure 8:
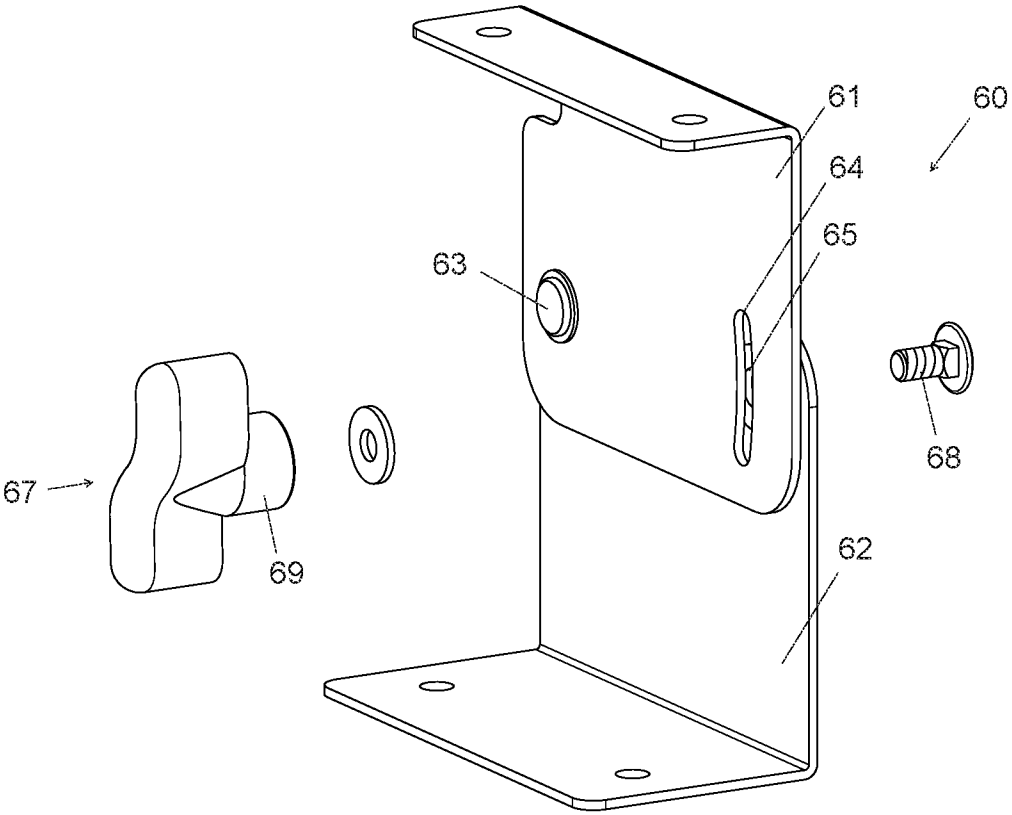
FIG. 8 is a close-up perspective partially exploded view of a tilt adjustment assembly of the example workstation shown in FIG. 1.
Figure 9:
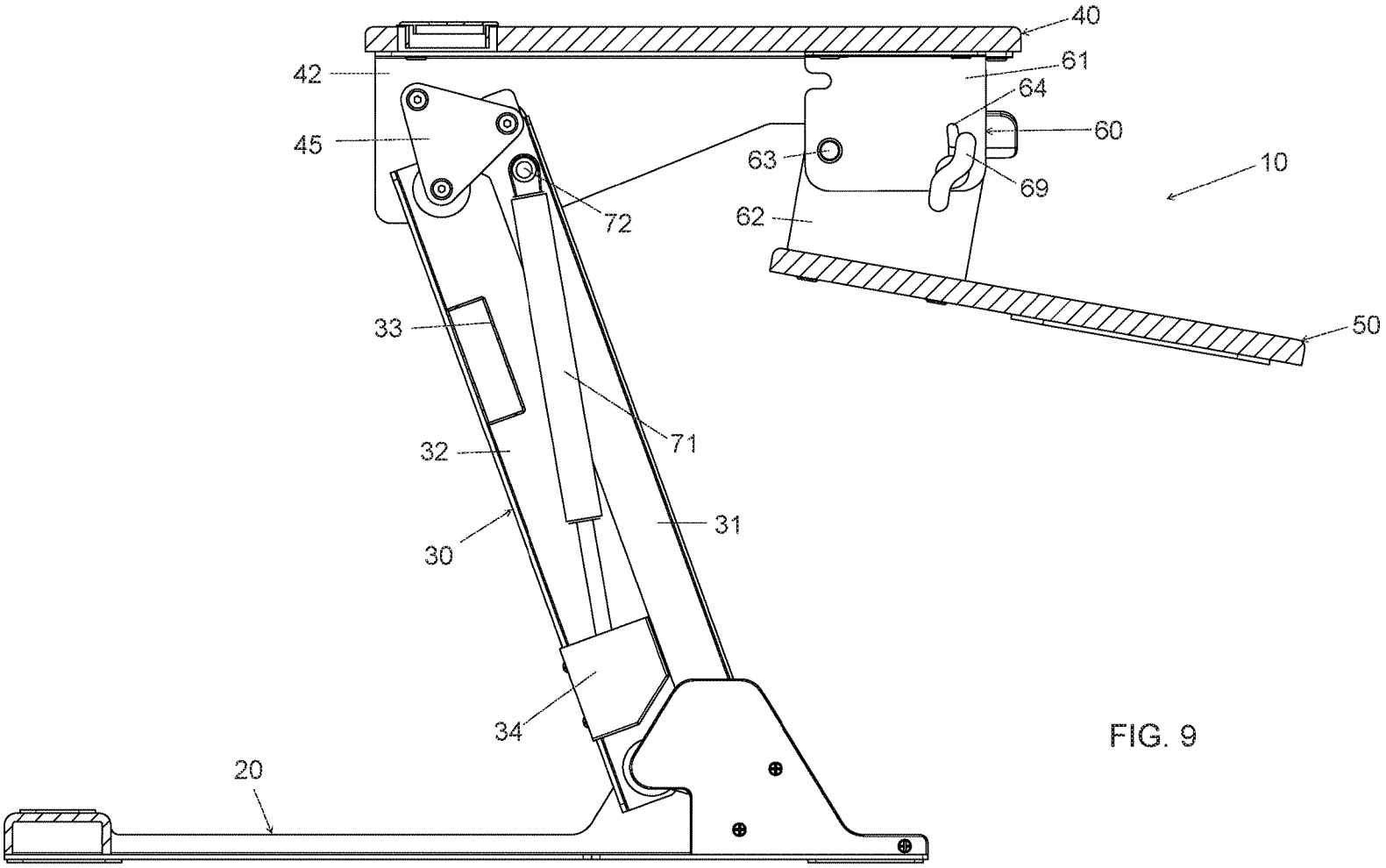
FIG. 9 is a cross-section side view of a right portion of the example workstation with the first platform in the first raised position shown in FIG. 2 but with the second platform in an angular position tilted rearward, and with portions of the height adjustment assembly removed for easier viewing of the underlying structure.
Figure 10:
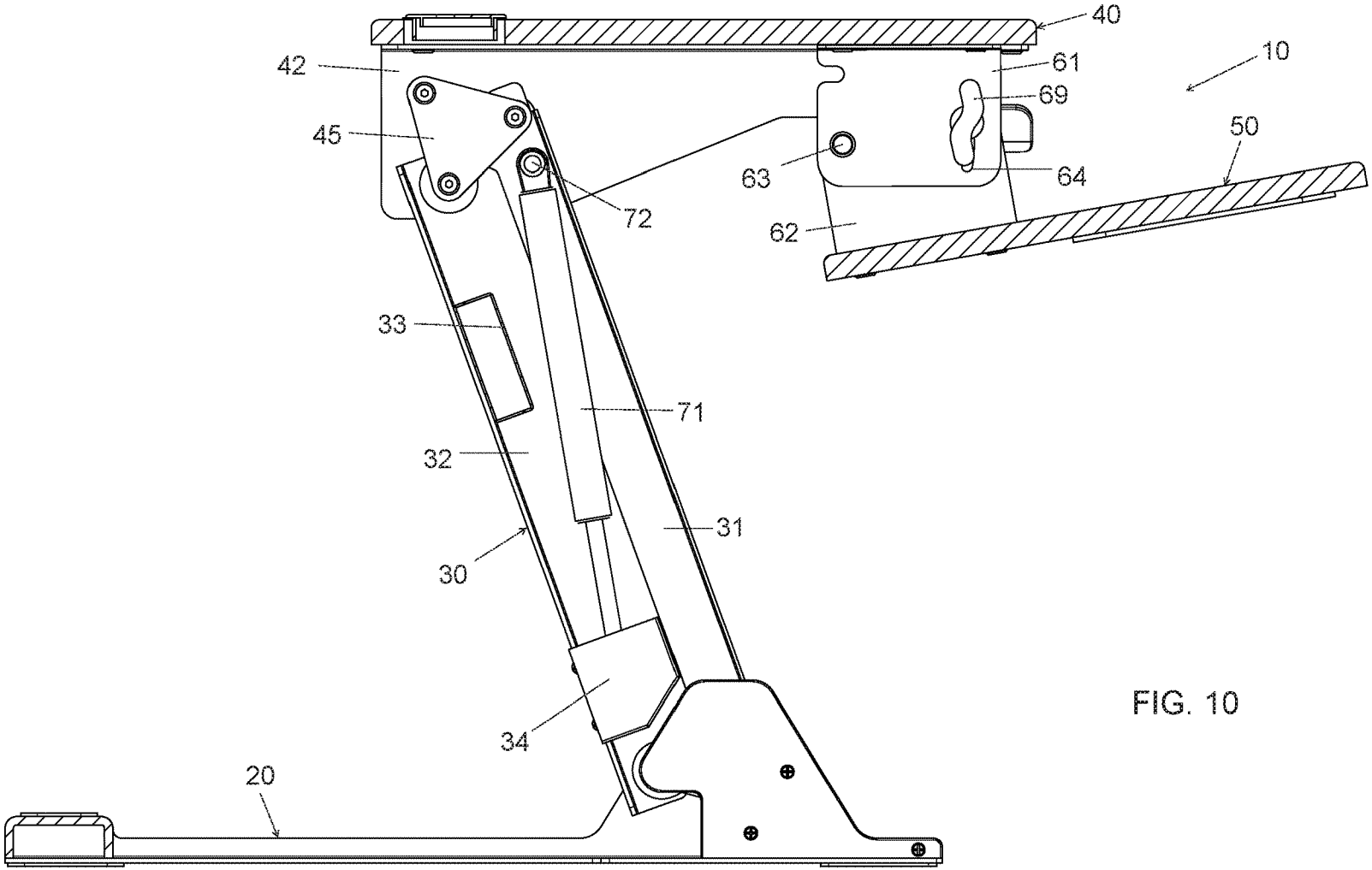
FIG. 10 is a cross-section side view of a right portion of the example workstation with the first platform in the first raised position shown in FIG. 2 but with the second platform in an angular position tilted forward, and with portions of the height adjustment assembly removed for easier viewing of the underlying structure.

To provide for the adjustment of the height of the first platform, the leg assembly 30 of the example workstation 10 further includes a height adjustment assembly 70 that may be best seen in FIGS. 4 and 5. The height adjustment assembly 70 includes at least one gas cylinder 71 that assists in supporting the first platform 40, and thereby also the second platform 50, when moving the first platform 40 between the lowered position shown in FIG. 1 and the first raised position shown in FIG. 2. In this example, the height adjustment assembly 70 happens to include two gas cylinders 71. It will be appreciated that use of a gas cylinder or gas spring is one alternative means of providing lift and height adjustment to a workstation. One of ordinary skill in the art will understand that other lifting and/or load bearing structures may be utilized for height adjustment of a workstation, whether using other configurations of a gas spring, or using more traditional coil or leaf springs, or other suitable structures that may provide lift or counterbalance.

Each gas cylinder 71 is coupled to a pair of legs 31, 32, including being pivotally coupled at an upper end to a forward leg 31 at a pivot 72, and pivotally coupled at a lower end to a rearward leg 32 at a pivot 73. Each gas cylinder 71 also includes a locking mechanism 74 at its lower end, and the workstation 10 includes a cable system 75 that is actuatable to operate the locking mechanism 74 on the at least one gas cylinder 71. Each lower pivot 73 and locking mechanism 74 is protected by a cover 34, which shields the moving parts and avoids potential pinch points. The cable system 75 includes a paddle 76 at an upper end, which is pivotally coupled to the first platform 40 by a housing 77 that is connected to the lower surface of the first platform 40, and a lever 78 at a lower end to actuate the locking mechanism 74 of the gas cylinder 71. A cable 79 is connected at its upper end to the paddle 76 and at its lower end to the lever 78. The paddle 76 is used to actuate the cable 79, and therefore, the locking mechanism 74. The pressure in the gas cylinder 71 provides the return bias for the cable system 75, to return the paddle 76 to a ready position shown in FIG. 4. The locking mechanism 74 of each gas cylinder 71 permits the example workstation 10 to be adjusted to essentially any desired height between the lowered position shown in FIG. 1 and the first raised position shown in FIG. 2. Covers 34 may be used for aesthetics, to provide protection and reduce pinch points by shielding the locking mechanism 74, lever 78 and lower end of the cable 79 along the inner side of each rear leg 32. The covers 34 may be constructed of similar materials and installed in a similar manner to the aforementioned covers 26.

The tilt adjustment assembly 60 of the example workstation 10 is coupled to the first platform 40 and the second platform 50. In this example, on each side of the workstation 10, the tilt adjustment assembly 60 includes an upper bracket 61 that is connected to the first platform 40 and a lower bracket 62 that is connected to the second platform 50. For improved support and aesthetics, the upper bracket 61 is connected to the lower surface of the first platform 40, and the lower bracket 62 extends along recessed areas 54 in the sides of the second platform 50, as may be seen in FIGS. 1-3, and is connected to the lower surface of the second platform 50. The connection of the upper and lower brackets 61, 62 to the upper and lower platforms 40, 50 is shown simplistically by fasteners, such as screws, but it will be appreciated that the connections may be made by suitable means, such as by adhesives, other fasteners or the like.

As may be appreciated from FIGS. 4-6 and 8-10, on each side of the workstation 10, the upper and lower brackets 61, 62 are pivotally coupled at a pivot 63. In this example, each upper bracket 61 further includes an arcuate opening 64 that is spaced from the pivot 63 and each lower bracket 62 includes an aperture 65 that is aligned with the arcuate opening 64. On the left side of the example workstation 10, the tilt adjustment assembly 60 further includes a post 66 that may be provided for instance by a bolt and nut, which are not tightened to the point of applying a clamping load. On the left side, the post 66 extends from the aperture 65 in the lower bracket 62 and is located within and slidable relative to the arcuate opening 64 in the upper bracket 61.

On the right side of the example workstation 10, the tilt adjustment assembly 60 includes a clamping mechanism 67, which includes a threaded bolt 68 and a corresponding threaded knob 69. The bolt 68 is located in the aperture 65 of the lower bracket 62 and extends through the arcuate opening 64 in the upper bracket 61. When the knob 69 is loosened, the lower bracket 62 is pivotable relative to the upper bracket 61 about the pivot 63, as the bolt 68 moves within the arcuate opening 64. This permits angular adjustment of the second platform 50 relative to the upper platform 40. When a desired angular position of the second platform 50 is selected, the knob 69 may be tightened by hand to apply a clamping load to prohibit further pivotal movement of the lower bracket 62 and the second platform 50 relative to the upper bracket 61 and the first platform 40. It will be appreciated that while the example workstation 10 conveniently includes a single clamping mechanism on the right side of the workstation and uses a bolt and knob, alternative tilt adjustment assemblies may be utilized in other configurations and on a single side or both sides of the workstation.

One may consider the first platform 40 to have an upper surface that generally comprises a first planar surface 41 and the second platform 50 to have an upper surface that generally comprises a second planar surface 51. The tilt adjustment assembly 60 may be adjusted to have at least first and second angular positions of the second platform 50 relative to the first platform 40. For instance, a first angular position may be achieved when the second planar surface 51 of the second platform 50 is parallel to the first planar surface 41 of the first platform 40, such as may be seen in FIGS. 2, 3 and 5. A second angular position may be achieved when the second planar surface 51 has a rearward angle relative to the first planar surface 41, such as may be seen in FIG. 9, where the second planar surface 51 is tilted toward the user. Alternatively, a workstation may have first and second angular position where the first angular position is when the second planar surface 51 is parallel to the first planar surface 41, such as again may be seen in FIGS. 2, 3 and 5, and with the second angular position being achieved when the second planar surface 51 has a forward angle relative to the first planar surface 41, such as may be seen in FIG. 10, where the second planar surface 51 is tilted away from the user. Of course, as is shown with the example workstation 10, if one considers the second angular position to be when the second planar surface 51 has a forward angle relative to the first planar surface 41, then the tilt adjustment assembly 60 may provide at least a third angular position of the second platform 50 when the second planar surface 51 has a rearward angle relative to the first planar surface 41, such as may be seen in FIG. 9.

While the present disclosure shows and describes example apparatus for adjustable ergonomic workstations, and methods of using the same, the example and alternatives discussed are merely illustrative and are not to be considered limiting. It will be apparent to those of ordinary skill in the art that apparatus in accordance with the present disclosure may be provided in various configurations, constructed of various materials and may be constructed to be used on various surfaces, such as a desk top, table top or other suitable surfaces, without departing from the scope or spirit of the present disclosure. Any variety of suitable materials of construction, configurations, shapes and sizes for the components and methods of coupling and connecting the components within the scope of the claims may be utilized to meet the particular needs and requirements of an end user. Thus, although example embodiments and methods of assembly relating to the adjustable ergonomic workstations have been described herein, the scope of coverage of this patent is not limited to the examples illustrated. On the contrary, this patent covers all methods, apparatus and articles of manufacture fairly falling within the scope of the appended claims either literally or under the doctrine of equivalents.

What is claimed is:

1. An adjustable ergonomic workstation comprising:

a base, a leg assembly, a first platform and a second platform;

the leg assembly being coupled to and extending between the base and the first platform, and being adjustable to move the first platform between at least a lowered position and a first raised position;

the leg assembly further comprising two pair of L-shaped legs coupled to the base and to the first platform and having outer portions that overlap;

a height adjustment assembly having at least one gas cylinder directly pivotally connected at a first end to one L-shaped leg of at least one of the pairs of L-shaped legs and directly pivotally connected at a second end to the second L-shaped leg of the at least one of the pairs of L-shaped legs, wherein the at least one gas cylinder is shielded by the overlap of the outer portions of the at least one pair of L-shaped legs to which it is connected, wherein the gas cylinder assists in supporting the first platform when moving the first platform between the lowered position and the first raised position;

the second platform being coupled to and positioned below the first platform; and the coupling of the second platform to the first platform including a tilt adjustment assembly wherein the second platform is adjustable between at least a first angular position and a second angular position relative to the first platform and the tilt adjustment assembly further comprises at least a clamping mechanism spaced apart from a pivot that is in a fixed location relative to the first and second platforms, and the clamping mechanism and pivot in the fixed location relative to the first and second platforms together control the relative angular position of the second platform relative to the first platform.

* * * * *